US005482162A

United States Patent [19]

Dickinson

[11] Patent Number: 5,482,162

[45] Date of Patent: Jan. 9, 1996

[54] TOOL CHEST ASSEMBLY CONSTRUCTED OF A PLASTIC MATERIAL

[75] Inventor: Thomas Dickinson, St. Louis, Mo.

[73] Assignee: Contico International, Inc., St. Louis, Mo.

[21] Appl. No.: 50,542

[22] Filed: Apr. 20, 1993

[51] Int. Cl.[6] ..... B65D 85/00

[52] U.S. Cl. ..... 206/373; 220/23.83

[58] Field of Search ..... 220/323, 315, 220/23.2, 23.4, 23.6, 23.8, 23.83, 23.86; 206/372, 373, 503, 504; 312/902, 290, 308, 348.1; 292/289, 288

[56] References Cited

U.S. PATENT DOCUMENTS

| | | | |
|---|---|---|---|
| 3,933,268 | 1/1976 | Buske | 206/504 X |
| 4,303,158 | 12/1981 | Perkins | 312/902 X |
| 4,383,721 | 5/1983 | Knaack et al. | 312/290 |
| 4,592,601 | 6/1986 | Hlinsky et al. | 206/504 X |
| 4,733,703 | 3/1988 | Cimino | 206/373 X |
| 4,768,651 | 9/1988 | Lanius | 312/902 X |
| 4,782,619 | 11/1988 | Richards | 312/902 X |
| 5,203,618 | 4/1993 | Oshall | 312/290 |
| 5,244,265 | 9/1993 | Chiang | 312/902 X |

OTHER PUBLICATIONS

Copy of advertisement for base cabinet and three–drawer mechanics chest (date unknown).

Copy of advertisement for Stack–On, home tool organizer (date unknown).

Copy of advertisement for Stack–On, six drawer tool chest and rollaway cabinet (date unknown).

Copy of advertisement for Craftsman, thirteen drawer storage set (date unknown).

Copy of advertisement for Craftsman, thirteen square foot of storage (Dec. 5, 1991).

Copy of Waterloo Industries, Inc. catalog (date unknown).

*Primary Examiner*—Jacob K. Ackun

*Attorney, Agent, or Firm*—Rogers, Howell & Haferkamp

[57] ABSTRACT

The present invention pertains to a tool chest assembly comprised of a lower chest and an upper chest that are both molded from a plastic material. The lower chest is supported on castered wheels and the upper chest is supported on the lower chest, and both the lower and upper chests have storage drawers mounted in front openings of the chests and closure members that close over the front openings of the chests.

77 Claims, 5 Drawing Sheets

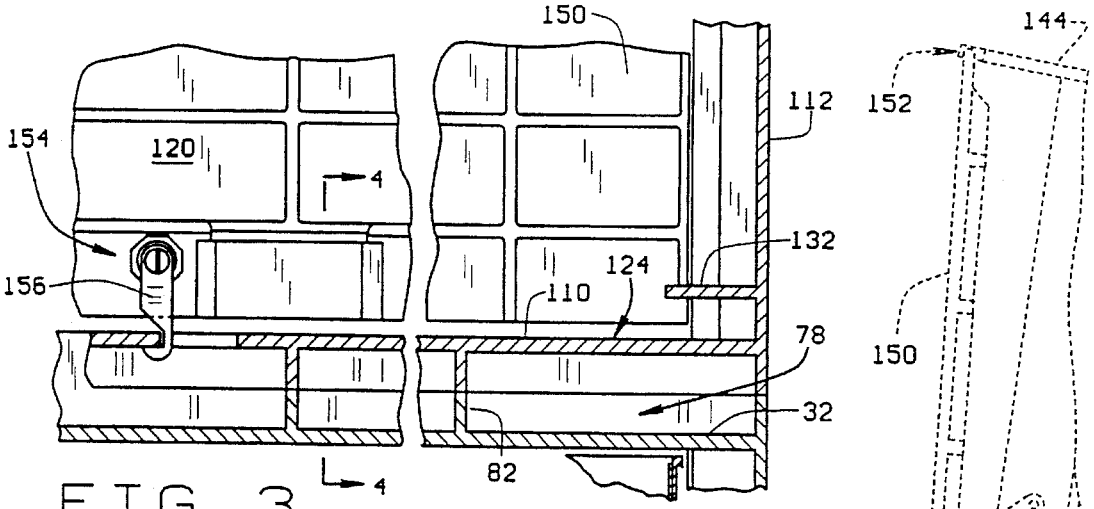
FIG. 3
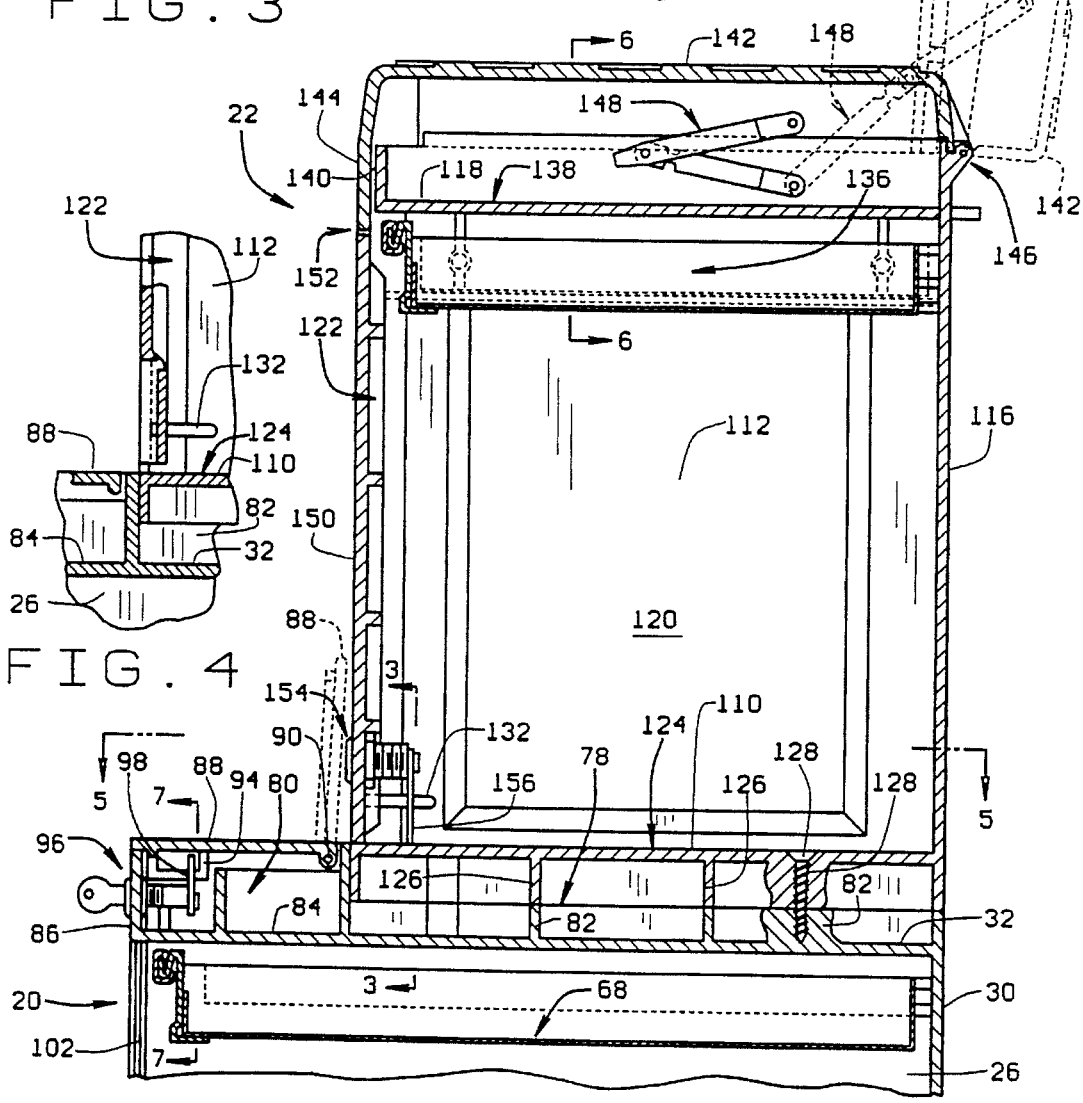
FIG. 4
FIG. 2

TOOL CHEST ASSEMBLY CONSTRUCTED OF A PLASTIC MATERIAL

BACKGROUND OF THE INVENTION

1. Field of the Invention

The present invention pertains to a tool chest assembly comprised of a lower chest and an upper chest that are both molded from a plastic material. The lower chest is supported on castered wheels and the upper chest is supported on the lower chest, and both the lower and upper chests have storage drawers mounted in front openings of the chests and closure members that close over the front openings of the chests.

2. Description of the Related Art

Prior art tool chest assemblies of the type provided by the present invention are typically constructed of sheet metal sections secured together by spot welds or spatially arranged threaded fasteners. The assembly of the separate sheet metal panels in the production of these types of tool chests is time consuming, labor-intensive and contributes significantly to their overall cost. Moreover, the strength of these tool chests is limited by the number of spot welds or threaded fasteners employed in connecting adjacent sheet metal panels of the chests together, and the useful life of these tool chests is determined by whether additional steps are taken during their construction to protect the parts from corrosion or rusting, which additional steps also contribute to the overall cost of the tool chests.

SUMMARY OF THE INVENTION

The present invention overcomes disadvantages commonly associated with prior art tool chest assemblies by providing a tool chest assembly comprised of a lower chest and an upper chest that are both molded from a plastic material. By constructing the lower and upper chests of the assembly from molded plastic components the steps involved in their construction are reduced from those involved in constructing prior art tool chest assemblies of sheet metal. Thereby, the cost of production of the tool chest assembly of the invention is reduced from that of prior art tool chest assemblies. Moreover, by molding the bottom and top panels, sidewalls and back walls of both the lower and upper chests of the tool chest assembly as single units of plastic material, continuous linear connections are provided between the sidewalls, back wall, and bottom and top panels of the lower and upper chests, such linear connections having a greater strength than the connections provided by spot welds and threaded fasteners employed in constructing prior art sheet metal tool chests. Constructing the lower and upper tool chests of the tool chest assembly of the invention from a plastic material also gives the assembly the characteristic of being corrosion resistant without requiring rust resisting treatments or painting as is typically required with prior art sheet metal tool chests. Constructing the lower and upper chests of the tool chest assembly of the invention from plastic also significantly decreases the overall weight of the assembly from that of prior art sheet metal tool chests and thereby reduces their shipping costs and facilitates their handling. The tool chest assembly of the invention is also constructed with several novel compartments and locking mechanisms that secure closure members of the tool chest assembly in closed positions protecting the contents of the tool chest assembly.

BRIEF DESCRIPTION OF THE DRAWINGS

Further objects and features of the present invention are revealed in the following detailed description of the preferred embodiment of the invention and in the drawing figures wherein:

FIG. 2 is a side view, in section, of the upper chest of the assembly taken along the line 2—2 of FIG. 1;

FIG. 3 is a partial view, in section, of a lock mechanism of the tool chest assembly taken along the line 3—3 of FIG. 2;

FIG. 4 is a partial view, in section, of a closure member of the assembly taken along the line 4—4 of FIG. 3;

DESCRIPTION OF THE PREFERRED EMBODIMENT

Figure 1:
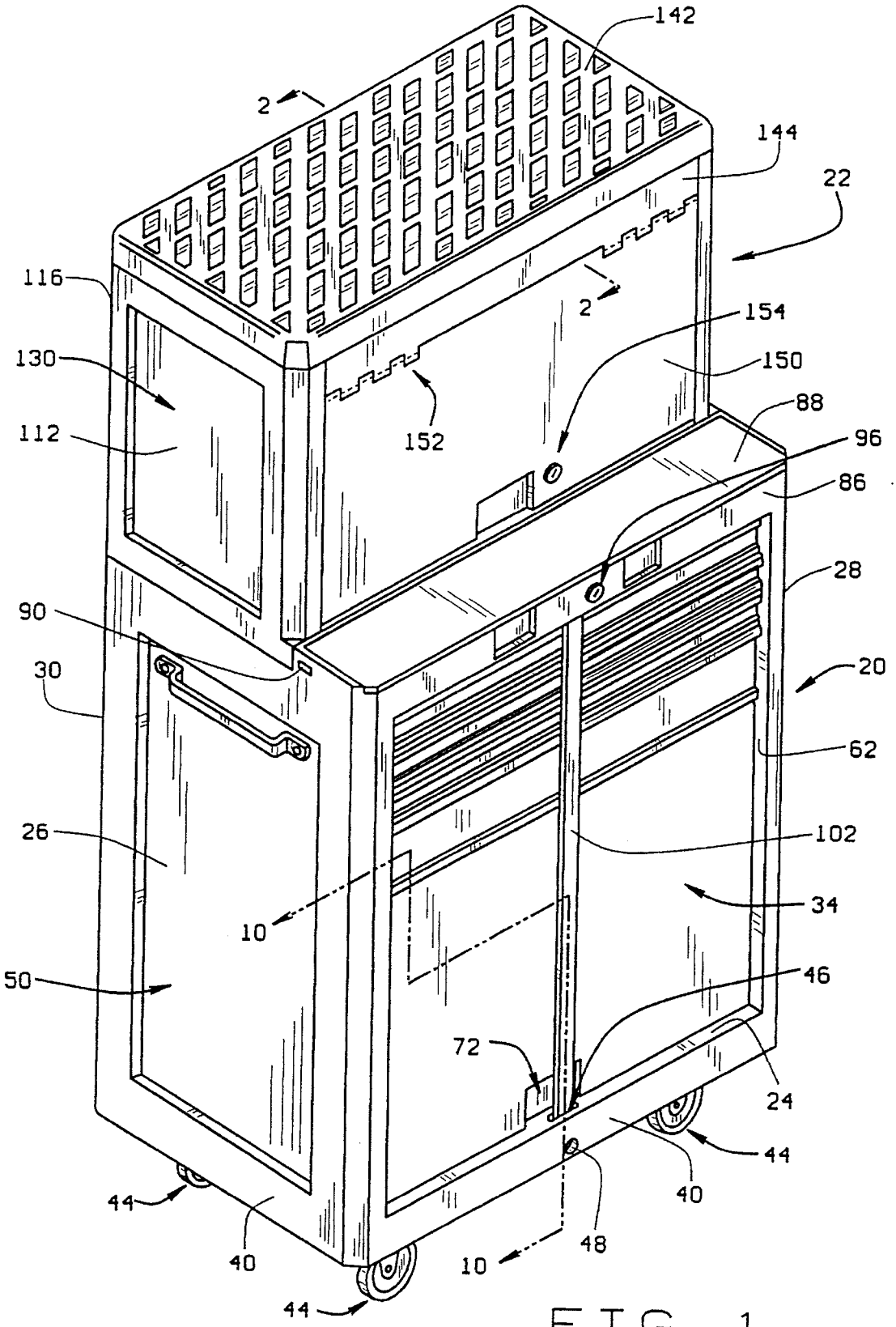
FIG. 1 is a perspective view of the tool chest assembly of the invention.
Figure 6:
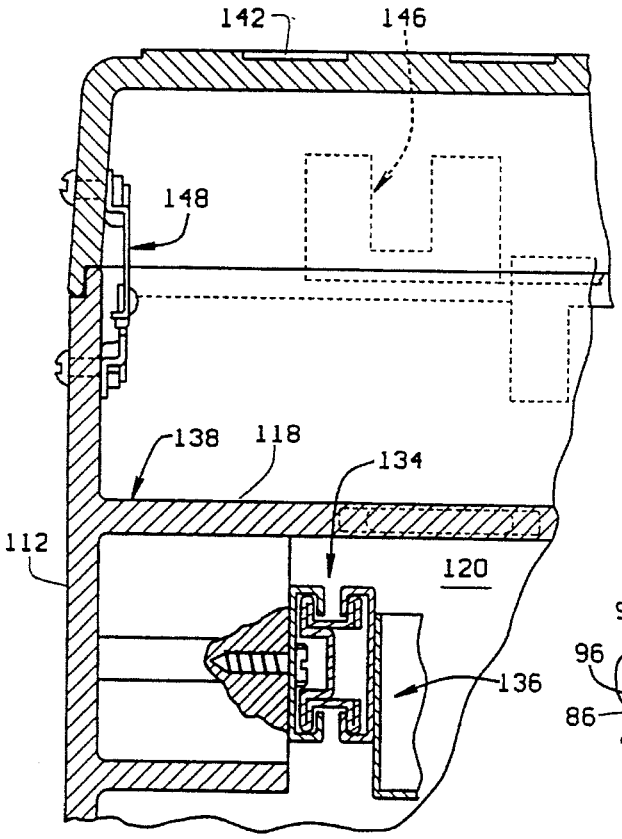
FIG. 6 is a partial view, in section, of the upper chest lid taken along the line 6—6 of FIG. 2.
Figure 9:
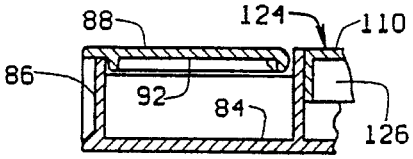
FIG. 9 is a partial view, in section, of the detail of a closure member of the lower chest, taken along the line 9—9 of FIG. 5.
Figure 8:
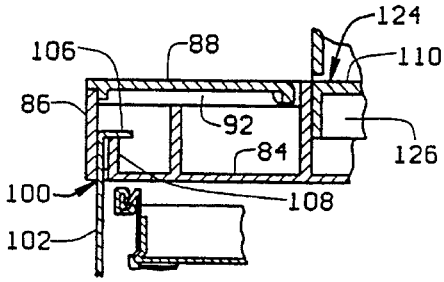
FIG. 8 is a partial view, in section, of the detail of the lower chest locking mechanism taken along the line 8—8 of FIG. 7.
Figure 7:
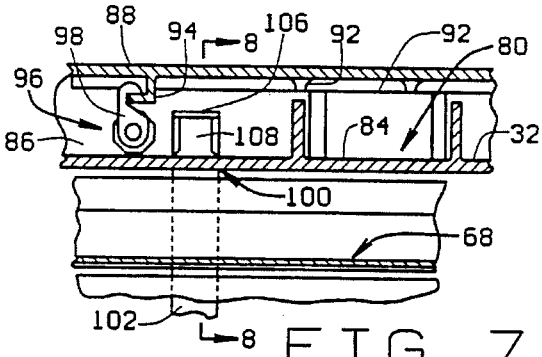
FIG. 7 is a partial view, in section, showing detail of a locking mechanism of the assembly lower chest taken along the line 7—7 of FIG. 2.
Figure 5:
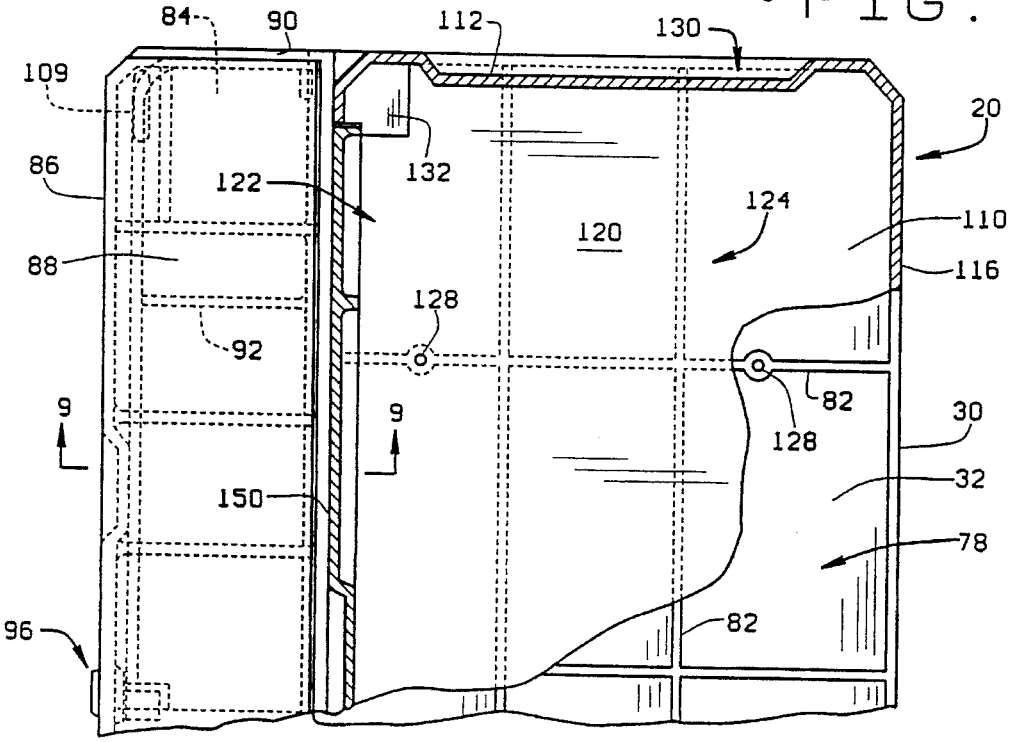
FIG. 5 is a partial view, in section, of the top panel of the lower chest of the assembly taken along the line 5—5 of FIG. 2.

The tool chest assembly of the present invention is basically comprised of a lower chest 20 and an upper chest 22. Both the lower and upper chests are constructed of a molded plastic material that gives the chests the characteristics of being lightweight, corrosion resistant, less expensive to manufacture and gives the chests stronger connections between adjacent walls and panels of the chests as will be explained.

The lower chest 20 is comprised of a bottom panel 24, a left sidewall 26 and right sidewall 28, a back wall 30 and a top panel 32. The bottom panel, left and right sidewalls, back wall and top panel are all molded together from a plastic material in a single unit having a boxlike configuration with a front opening 34. Constructing the lower chest in this manner provides continuous, linear connections of the bottom edges of the left and right sidewalls and back wall with the bottom panel of the chest. Likewise, molding the chest as a single unit provides continuous, linear connections of the top edges of the left and right sidewalls and back wall with the top panel of the chest. The continuous molded connections between the component parts of the lower chest give it a structural strength and rigidity that is not obtainable in prior art tool chest construction where component parts are connected together at intermittent points by spot welds or threaded fasteners. It should also be appreciated that by constructing the lower chest as a single integrally molded unit, the time and cost of production are significantly reduced from that of prior art tool chests that require additional labor hours to assemble each of the chest's component parts together by spot welds or fasteners.

Figure 10:
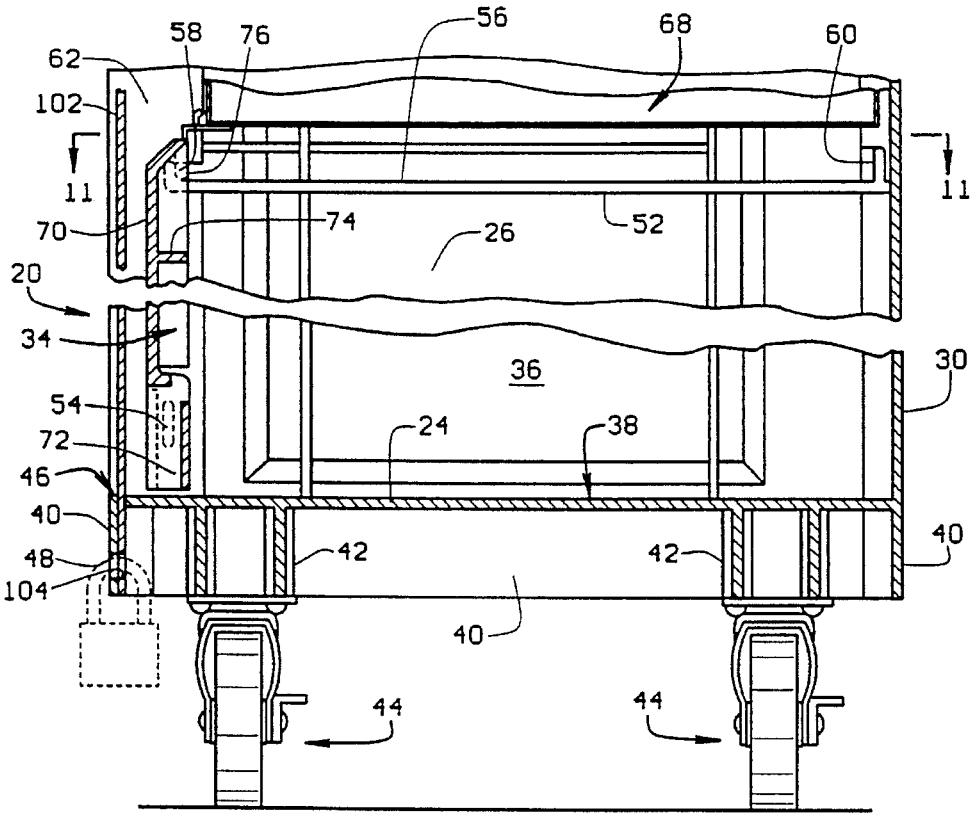
FIG. 10 is a partial view, in section, of the assembly lower chest taken along the line 10—10 of FIG.
Figure 11:
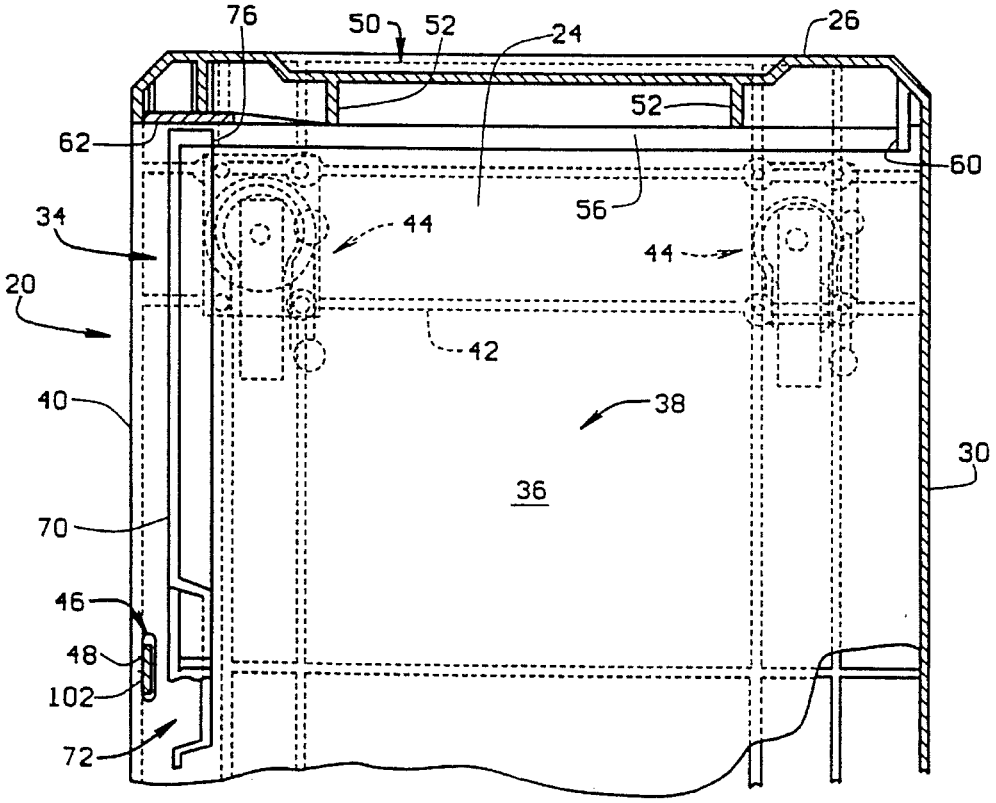
FIG. 11 is a partial view, in section, of the assembly lower chest taken along the line 11—11 of FIG. 10.
Figure 12:
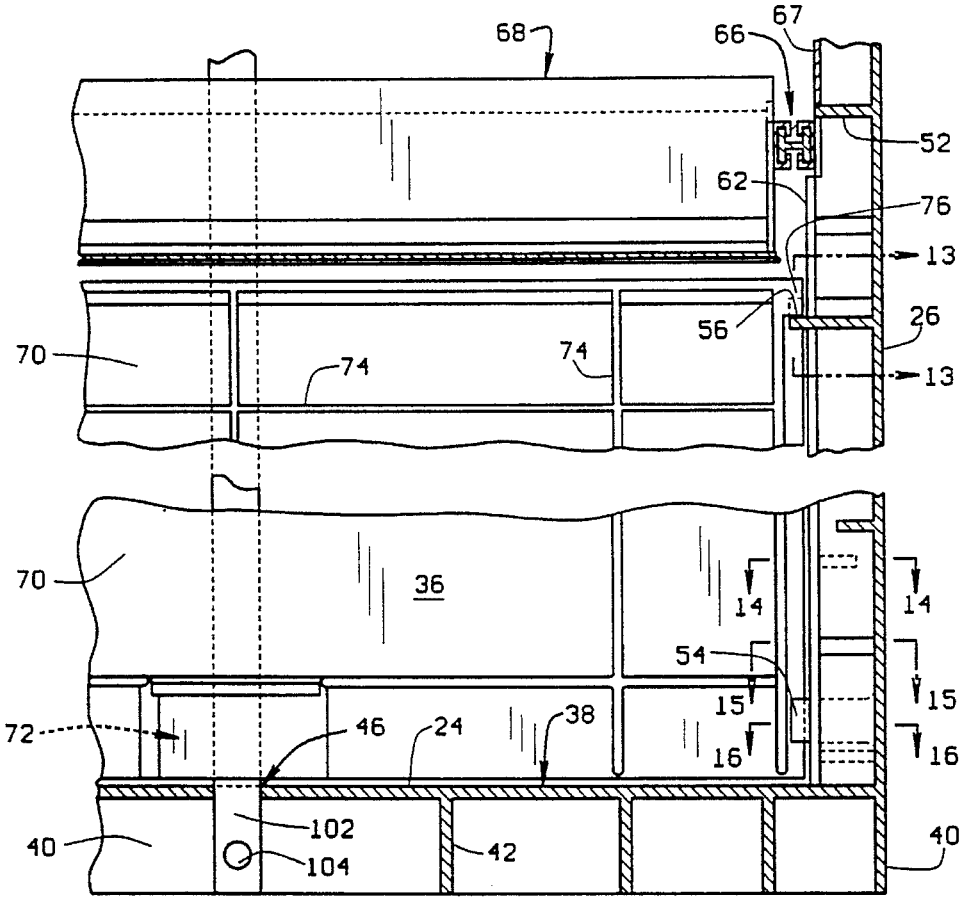
FIG. 12 is a partial view, in section, of lower chest closure members.
Figure 13:
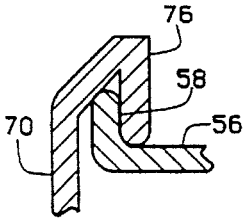
FIG. 13 is a partial view, in section, showing the detail of a pivoting connection between a closure door and the lower chest.

As best seen in FIGS. 10–12, the lower chest bottom panel 24 is formed with a top support surface 38 in the chest interior volume 36, a reinforcing perimeter band 40 extending downwardly from the perimeter of the bottom panel, and a plurality of crisscrossing reinforcing webs 42 molded on the underside of the bottom panel providing structural strength and rigidity to the panel. Four wheel assemblies 44 are mounted to the underside of the bottom panel 24 at intersections of the reinforcing webs 42. In the preferred embodiment, two of the wheel assemblies 44 at either the left side or right side of the lower chest are castor wheel assemblies. Adjacent the forward edge of the bottom panel 24 a lock bar slot 46 is provided through the panel top surface 38 just behind the perimeter band 40 and a padlock hole 48 is provided through the perimeter band 40 just below the lock bar slot.

Figure 14:
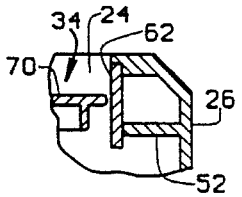
FIG. 14 is a partial view, in section, taken along the line 14—14 of FIG. 12.
Figure 15:
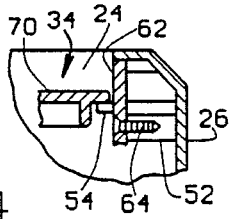
FIG. 15 is a partial view, in section, taken along the line 15—15 of FIG. 12.
Figure 16:
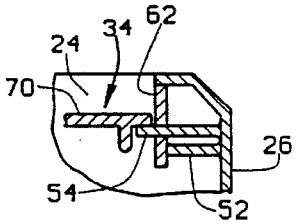
FIG. 16 is a partial view, in section, taken along the line 16—16 of FIG. 12.

The left and right sidewalls 26, 28 of the lower chest are mirror images of each other and only the left sidewall 26 will be described. The left sidewall 26 is molded unitarily with the left hand edge of the lower chest bottom panel 24 forming a continuous, linear connection between the left sidewall and the bottom panel along the entire length of the connection of the sidewall to the bottom panel. The left sidewall extends upwardly from the bottom panel and is molded with a depression 50 in its exterior surface and pluralities of crisscrossing webs 52 molded on its interior surface. Together the depression 50 and crisscrossing webs 52 add structural strength and rigidity to the sidewall. An abutment tab 54 projects from the interior surface of the sidewall 26 adjacent the lower chest bottom panel 24. The abutment tab is provided to engage with a closure member as will be explained. A horizontal rail 56 is molded projecting from the interior surface of the sidewall. As best seen in FIG. 11, the rail 56 projects inwardly into the interior volume of the lower chest beyond the crisscrossing webs 52 molded on the interior surface of the sidewall. The rail is formed with a forward lip 58 and a rearward lip 60, the purpose for which will be explained. A trim piece 62 is secured to the interior surface of the sidewall 26 adjacent the front opening 34 of the lower chest. The trim piece gives the lower chest opening a clean appearance surrounding the opening. As best seen in FIGS. 14–16, the trim piece 62 extends upwardly along the interior surface of the sidewall 26 bounding the left and right sides of the lower chest opening 34 and is secured to the sidewall interior surface by threaded fasteners 64. In FIG. 15, it can be seen that where threaded fasteners 64 are required to secure together component parts of the chest assembly of the invention they provide a more secure connection than do threaded fasteners used in connecting sheet metal components of prior art chests. In FIG. 15 it can be seen that the entire threaded length of the fastener 64 provides the connection between the trim piece 62 and a reinforcing web 52 of the sidewall where in prior art sheet metal tool chests only that portion of a threaded fastener's length that passes through overlapping sheet metal parts provides the connection between the parts. Roller tracks 66 are secured to the interior of the sidewall 26 toward the top of the sidewall by a metal drawer frame 67. The drawer frame is a flat sheet of metal having a series of horizontal grooves or openings therethrough that are spaced vertically over the frame. The spacing of the grooves corresponds to the positioning of several of the horizontal reinforcing webs 52 formed on the interiors of the sidewalls and the webs are inserted through the grooves to locate the frame on the interiors of the sidewalls and support the frames. As best seen in FIG. 12, one half of each of the roller tracks 66 are formed integrally from the drawer frame 67. The tracks 66 support sliding drawers. The roller tracks 66 and the sliding drawers 68 are conventional and are not described in detail. In the embodiment of the invention illustrated three such sliding drawers 68 are mounted in the lower chest interior volume 36 toward the top of the interior volume. The drawers 68 are arranged in a vertically stacked relative relation inside the chest interior volume for reciprocal horizontal movement of the drawers selectively out of the chest interior volume and back into the chest interior volume. With the drawers in their closed positions inside the interior volume of the lower chest, the front panels of the drawer each form a closure member in at least a portion of the lower chest front opening 34 preventing access into that portion of the chest interior volume occupied by the drawers.

Figure 17:
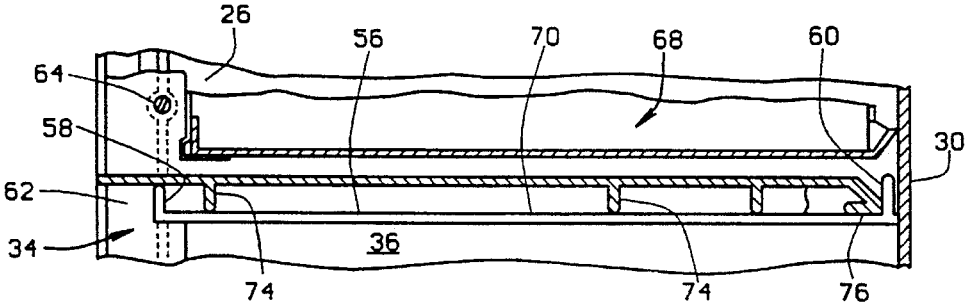
FIG. 17 is a partial view, in section, showing the detail of lower chest closure members.

An additional closure member in the form of a panel door 70 is also provided on the lower chest. The door 70 has a width dimension slightly smaller than the width dimension of the lower chest front opening 34 and a height dimension slightly smaller than the distance between the lower chest bottom panel 24 and the underside of the lowermost sliding drawer 68 mounted in the chest interior. As best seen in FIG. 10, the door 70 is provided with an indentation 72 centered at its lower end that is provided for use as a handle to manipulate the door. The interior surface of the door is molded with crisscrossing webs 74 that reinforce and add structural strength to the door. The top edge of the door is angled inwardly and an interior tab 76 extends downwardly from the door's angled top edge at opposite sides of the door. The tab 76 extends over the forward lip 58 of the horizontal rail 56 and provides a pivoting connection of the door 70 to the lower chest that suspends the door in the chest front opening 34. The abutment tabs 54 on the sidewalls prevents the door from being pushed through the front opening and into the chest interior volume. By manually gripping the indentation 72 of the door and pulling outwardly and upwardly the door is pivoted about the engagement of the tabs 76 at the opposite sides of the door with the forward lips of the horizontal rails 56. In this manner, the door 70 is pivoted open and displaced from the lower chest front opening 34 exposing the portion of the lower chest interior volume 36 directly behind the door and beneath the sliding drawers 68. With the door 70 pivoted forward and substantially horizontal with the sliding rails 56, the door is then pushed backward into the lower chest interior volume 36 and slides along the rails 56 to a position of the door shown in FIG. 17. In this position the door is stored out of the way of the lower chest front opening 34 providing easy access to the portion of the lower chest interior volume directly behind the door.

The back wall 30 of the lower chest is formed in substantially the same manner as the left and right sidewalls. The lower edge of the back wall 30 is formed unitarily with the back edge of the lower chest bottom panel 24 and extends upwardly from the bottom panel with its opposite left and right angled edges formed unitarily with the angled back edges of the left and right sidewalls. As set forth above with regard to the sidewalls, the connections between the back wall and the bottom panel and left and right sidewalls are continuous, linear connections provided by molding the lower chest as a single unit of a plastic material. The continuous, linear connections between the entire lengths of the back wall bottom and side edges and the bottom panel 24 and left and right sidewalls 26, 28 enhance the structural strength and rigidity of the lower chest 20.

The lower chest top panel 32 is divided into a rearward section 78 and a forward section 80. The opposite left and right edges of both the rearward and forward sections of the top panel are molded unitarily with the top edges of the left and right sidewalls and the back edge of the top panel rearward section is molded unitarily with the top edge of the lower chest back wall. Again, the continuous, linear connections between the top panel left and right and rearward edges with the respective left and right lower chest sidewalls and back wall enhance the structural strength and rigidity of the lower chest. As best seen in FIG. 4, the top surface of the top panel rearward section 78 is formed with a plurality of crisscrossing webs 80 that enhance the structural strength and rigidity of this section of the top panel. The rearward section is also recessed below the forward section to provide a clearance for the connection of the upper chest bottom panel as will be explained. The top panel forward section 80 is molded as a tray having a plurality of storage bins formed in its top surface. The tray separates the storage bins from the lower chest interior volume 36 so that the storage bins are only accessible through an access opening at the top of the tray. The tray 84 extends across the entire width of the lower chest 20 Just above the chest front opening 34 and a front wall of the tray 86 forms the upper border of the lower chest front opening. A panel door 88 extends over the tray 84 and forms a Work surface of the top panel forward section 80. The door 88 is connected to the lower chest 20 by pins 90 at its opposite left and right ends that engage in holes in the sidewalls 26, 28 at the opposite left and right sides of the tray 84. The pins 90 provide a pivoting connection of the door 88 to the lower chest over the tray 84 that enables the door to be pivoted upward to an open position displaced from the tray as shown in dashed lines in FIG. 2, exposing an access opening beneath the door providing access to the storage bins of the tray 84. The interior or underside of the panel door 88 is formed with a plurality of reinforcing webs 92 and with a lock hook 94. A lock mechanism 96 is mounted in the tray front wall 86 and a latch 98 of the lock engages over the door lock hook 94 with the door in its closed position over the tray to lock the door over the tray.

A lock bar slot 100 is provided through the bottom surface of the tray 84 adjacent the tray front wall 86. An elongate lock bar 102 having a padlock hole at its bottom end and a bend 106 at its top end is employed in locking the closure members in the lower chest front opening 34 in their closed position. The lock bar has a length slightly larger than the height of the lower chest front opening 34. In use, with the tray panel door 88 in its open position the lock bar lower end is inserted through the lock bar slot 100 in the bottom of the tray, downwardly past the lower chest closure members or sliding drawers 68 and panel door 70, into the lock bar slot 46 provided in the lower chest bottom panel 24. The lock bar padlock hole 104 is aligned with the padlock hole 48 through the bottom panel perimeter band 40 just behind the band. With the lock bar in this position the top bend 104 rests on an abutment 108 molded in the interior of the tray 84 and a padlock may be inserted through the aligned padlock holes of the lock bar 102 and the bottom panel band 40 to lock the bar in its position where it prevents the sliding drawers 68 from being pulled out of the interior volume of the lower chest and prevents the panel door 70 from being pivoted outward from the lower chest. Alternatively, without using a padlock, the lock bar can be locked in its position shown in FIG. 1 by closing the tray panel door 88 and locking the door in its closed position, thereby locking the lock bar bend 106 in the tray beneath the panel door 88 and preventing the lock bar from being withdrawn through the tray access opening. When the lock bar 102 is not in use it may be stored by inserting the bottom end of the bar through a storage slot 109 formed through the tray bottom and then inserting the length of the bar through the slot until the bend 106 rests on the tray bottom suspending the bar behind the trim piece 62.

Like the lower chest, the upper chest 22 is also comprised of a bottom panel 110, a left sidewall 112 and right sidewall 114, a back wall 116 and a top panel 118. The bottom panel, left and right sidewalls, back wall and top panel of the upper chest are also all molded together from a plastic material in a single unit having a boxlike configuration surrounding an interior volume 120 of the chest and having a front opening 122 providing access to the interior volume. Constructing the upper chest in this manner provides continuous, linear connections between the bottom edges of the left and right sidewalls and the back wall with the bottom panel of the chest. Likewise, molding the chest as a single unit provides continuous, linear connections between the top edges of the left and right sidewalls and the top edge of the back wall with the top panel of the chest. The continuous molded connections between the component parts of the upper chest give it a structural strength and rigidity that is not obtainable in prior art tool chest construction where component parts are connected together at intermittent points by spot welds or threaded fasteners. It should also be appreciated that by constructing the upper chest as a single integrally molded unit, the time and cost of production are significantly reduced from that of prior art tool chests that require additional labor hours to assemble each of the chest's component parts together by spot welds or fasteners. As best seen in FIG. 2, the upper chest bottom panel 110 is formed as the upper half of the rear section 78 of the lower chest top panel. The upper chest bottom panel has a top support surface 124 substantially coplanar with the panel door 88 of the lower chest except that the support surface is enclosed in the upper chest interior volume 120. A plurality of crisscrossing reinforcing webs 126 are molded on the underside of the bottom panel 110 providing structural strength and rigidity to the panel. The bottom panel 110 of the upper chest is secured to the rearward section of the lower chest top panel 32 by a plurality of threaded fasteners 128 screw threaded through the webs 126 of the upper chest bottom panel into the webs 82 of the rearward section of the lower chest top panel.

The left and right sidewalls 112, 114 of the upper chest are mirror images of each other and only the left sidewall 112 will be described. The left sidewall 112 is molded unitarily with the left hand edge of the upper chest bottom panel 110 forming a continuous, linear connection between the left sidewall and the bottom panel along the entire length of the connection between the sidewall and bottom panel. The left sidewall extends upwardly from the bottom panel and is molded with a depression 130 in its exterior surface that adds structural strength and rigidity to the sidewall. An abutment tab 132 projects from the interior surface of the sidewall 112 adjacent the bottom panel 110. The tab is provided to engage with a closure member as will be explained. Roller tracks 134 are secured to the interior of the sidewall toward the top of the sidewall. The tracks support sliding drawers. The roller tracks and the sliding drawers 136 are conventional and are not described in detail. In the embodiment of the invention illustrated, one sliding drawer 136 is mounted in the upper chest interior volume 120 toward the top of the volume. The drawer is mounted for reciprocal horizontal movement selectively out of the chest interior volume and back into the chest interior volume. With the drawer in its closed position inside the interior volume of the upper chest, the front panel of the drawer forms a closure member in at least a portion of the upper chest front opening 122 preventing access into that portion of the chest interior volume occupied by the drawer. If so desired, the remainder of the upper chest interior volume may also be occupied by additional sliding drawers arranged in a vertically stacked relative relation just as was done in the interior volume of the lower chest.

The back wall 116 of the upper chest is formed in substantially the same manner as the left and right sidewalls. The lower edge of the back wall is formed unitarily with the back edge of the upper chest bottom panel 110 and extends upwardly from the bottom panel with its opposite left and right side angled edges formed unitarily with the angled back edges of the left and right sidewalls, respectively. As set forth above with regard to the upper chest sidewalls and with regard to the lower chest, the connections between the back wall and the bottom panel and left and right sidewalls are continuous, linear connections provided by molding the upper chest as a single unit of plastic material. The continuous, linear connections between the entire lengths of the connections of the back wall 116 with the bottom panel 110 and the left and right sidewalls 112, 114 enhance the structural strength and rigidity of the upper chest 22.

The upper chest top panel 118 is formed as a tray or storage bin having a bottom surface 138 separating an interior volume of the storage bin from the remainder of the interior volume 120 of the upper chest. As best seen in FIG. 2, the storage bin surface 138 is formed with a front wall 140 at its forward edge and upper portions of the left and right sidewalls 112, 114 and the back wall 116 of the upper chest surround the storage bin surface 138 on all four sides. The storage bin front wall 140 forms a top border of the upper chest front opening 122.

A lid 142 is positioned on the topmost edges of the left and right upper chest sidewalls 112, 114 and back wall 116 completely covering over the storage bin 138 formed by the upper chest top panel. A front panel 144 of the lid extends downwardly slightly beyond the front wall 140 of the upper chest storage bin 138 as best seen in FIG. 2. The lid is connected by a hinge assembly 146 along its rearward edge to the topmost edge of the upper chest back wall 116. The hinge connection enables the lid to pivot between its closed position shown in full lines in FIG. 2 and its open position shown in dashed lines in FIG. 2. A pair of support linkages 148 are each connected between the left and right upper chest sidewalls 112, 114 and the lid 142 to hold the lid in its open position shown in dashed lines in FIG. 2. It can be seen in FIG. 2 that with the lid in its closed position, it prevents access to the area of the storage bin 138.

A front door 150 is connected to the lower edge of the lid front panel 144 by a hinge assembly 152. The front door 150 has a configuration that, with the front panel 144 of the lid, completely covers over the front opening 122 of the upper chest. The front door 150 moves with the lid 142 as the lid is pivoted to its open position shown in dashed lines in FIG. 2 and is suspended by the hinge assembly 152 in front of the opened lid 142 out of the way of the storage bin 138. With both the lid 142 and the front door 150 moved to their closed position shown in full lines in FIG. 2, the front door 150 completely covers over the upper chest front opening 122 and prevents access to the chest interior volume 120. The tabs 132 prevent the front door 150 from being pushed through the front opening and into the upper chest interior volume. The front door 150 also extends over the drawer 136 in the upper chest and prevents access to the drawer when the door is in its closed position. A lock mechanism 154 is provided adjacent the lower edge of the door 150. The lock mechanism comprises a hook 156 that is turned and passes through a slot 158 in the upper chest bottom panel 110 engaging beneath the bottom panel to lock the front door 150 in its closed position over the front opening of the upper chest.

While the present invention has been described by reference to a specific embodiment, it should be understood that modifications and variations of the invention may be constructed without departing from the scope of the invention defined in the following claims.

What is claimed is:

1. A tool chest assembly comprising:

a lower chest having a bottom panel, left and right sidewalls, a back wall and a top panel that are all connected together in a box configuration surrounding an interior volume of the lower chest and having a front opening providing access to the interior volume;

an upper chest having a bottom panel, left and right sidewalls, a back wall and a top panel that are all connected together in a box configuration surrounding an interior volume of the upper chest and having a front opening providing access to the interior volume of the upper chest;

the top panel of the lower chest is divided into forward and rearward sections, the upper chest is positioned on the rearward section and the forward section projects forwardly of the upper chest front opening; and, a tray is provided in the interior volume of the lower chest beneath the forward section of the lower chest top panel, and the forward section of the lower chest top panel is connected to the lower chest for movement of the forward section relative to the lower chest between a closed position where the forward section covers over the tray and an open position where the forward section is displaced from over the tray exposing an access opening to the tray.

2. The tool chest assembly of claim 1, wherein:

the tray is configured as a storage bin having a storage compartment that is separated from the interior volume of the lower chest by the tray and is accessible only through the access opening exposed when the forward section of the lower chest top panel is moved to the open position.

3. The tool chest assembly of claim 1, wherein:

the forward section of the lower chest top panel is connected to the lower chest for pivoting movement of the forward section relative to the lower chest between the closed and open positions.

4. The tool chest assembly of claim 1, wherein:

at least one closure member is mounted on the lower chest for movement of the closure member relative to the lower chest between a closed position where the closure member is positioned in the front opening of the lower chest and prevents access to at least a portion of the lower chest interior volume, and an open position where the closure member is displaced from the front opening of the lower chest and allows access to the portion of the lower chest interior volume; and a means for locking the closure member in the closed position is provided in the tray.

5. The tool chest assembly of claim 4, wherein:

the closure member is a drawer mounted in the interior volume of the lower chest for sliding movement relative to the lower chest backward and forward through the front opening of the lower chest.

6. The tool chest assembly of claim 4, wherein:

the closure member is a door mounted on the lower chest for pivoting movement relative to the lower chest between a closed position where the door is positioned in at least a portion of the lower chest front opening and an open position where the door is displaced from the portion of the lower chest front opening.

7. The tool chest assembly of claim 4, wherein:

the means for locking the closure member in the closed position is an elongate bar having opposite bottom and top ends where the bottom end of the bar is inserted downwardly through a hole in the tray and the bar is positioned in front of the closure member with the bar top end positioned in the tray above the hole in the tray to lock the closure member in the closed position, and the bar is withdrawn upwardly through the hole in the tray from in front of the closure member and out of the tray through the tray access opening to unlock the closure member.

8. The tool chest assembly of claim 1, wherein:

the upper chest is provided with a lid that is connected to the upper chest for movement of the lid relative to the upper chest between a closed position where the lid covers over the top panel of the upper chest and a open position where the lid is displaced from over the top panel of the upper chest; and, a closure member is connected to the lid for movement of the closure member relative to the lid with the lid in its closed position wherein the movement of the closure member is between a closed position where the closure member is positioned in at least a portion of the upper chest front opening and an open position where the closure member is displaced from the upper chest front opening.

9. The tool chest assembly of claim 8, wherein:

the lid has opposite rearward and forward edges and a hinge assembly connects the lid rearward edge to the upper chest, and the closure member is a door having a top edge and a hinge assembly connects the door top edge to the lid forward edge.

10. The tool chest assembly of claim 1, wherein:

the top and bottom panels, left and right sidewalls and the back wall of the lower chest are all molded together as a single unit of a plastic material and the top and bottom panels, left and right sidewalls and the back wall of the upper chest are all molded together as a single unit of a plastic material.

11. A tool chest assembly comprising:

a lower chest having a bottom panel, left and right sidewalls, a back wall and a top panel that are all connected together in a box configuration surrounding an interior volume of the lower chest and having a front opening providing access to the interior volume;

an upper chest having a bottom panel, left and right sidewalls, a back wall and a top panel that are all connected together in a box configuration surrounding an interior volume of the upper chest and having a front opening providing access to the interior volume of the upper chest, the upper chest being positioned on the top panel of the lower chest;

a lid connected to the top panel of the upper chest for movement of the lid relative to the upper chest between a closed position where the lid covers over the top panel of the upper chest and an open position where the lid is displaced from covering over the top panel of the upper chest; and, a front panel is connected to the lid for movement of the front panel relative to the lid where, with the lid in its closed position, the front panel is movable between a closed position relative to the lid where the front panel covers over at least a portion of the front opening of the upper chest preventing access to the interior volume of the upper chest through the portion of the front opening, and an open position where the front panel is displaced from covering the portion of the front opening allowing access to the upper chest interior volume through the portion of the front opening.

12. The tool chest assembly of claim 11, wherein:

in the closed position of the lid the front panel covers over the entire front opening of the upper chest preventing access to the upper chest interior volume and in the open position of the lid, the lid is displaced from the upper chest front opening.

13. The tool chest assembly of claim 11, wherein:

at least one drawer is mounted in the interior volume of the upper chest for sliding movement relative to the upper chest backward and forward through the front opening of the upper chest and the lid in its closed position covers over the drawer preventing the drawer movement forward through the upper chest front opening.

14. The tool chest assembly of claim 11, wherein:

a lock mechanism is provided on the lid for selectively locking the lid to the top panel of the lower chest when the lid is in its closed position.

15. The tool chest assembly of claim 11, wherein:

the lower chest top panel is divided into forward and rearward coplanar sections and the upper chest is positioned on the rearward section with the forward section projecting horizontally in front of the upper chest front opening and in front of the front panel with both the lid and the front panel in their closed positions.

16. The tool chest assembly of claim 15, wherein:

a tray is mounted inside the interior volume of the lower chest beneath the forward section of the lower chest top panel and the forward section of the top panel is connected to the lower chest for movement relative to the lower chest between a closed position where the forward section covers over the tray and an open position where the forward section is displaced from over the tray and exposes an access opening through the top panel of the lower chest providing access to the tray.

17. The tool chest assembly of claim 16, wherein:

at least one closure member is mounted on the lower chest for movement relative to the lower chest between a closed position where the closure member is positioned in the front opening of the lower chest blocking access to at least a portion of the interior volume of the lower chest through the lower chest front opening, and an open position where the closure member is displaced from the lower chest front opening enabling access to the portion of the lower chest interior volume; and, an elongate bar having opposite top and bottom ends is mounted on the lower chest with the bar bottom end being inserted downwardly through a hole in the tray and in front of the closure member with the bar top end being positioned in the tray hole to prevent movement of the closure member from its closed to its open position, the bar being removable upwardly through the tray hole from in front of the closure member and out of the tray through the tray access opening to enable movement of the closure member from its closed to its open position.

18. A tool chest assembly comprising:

a lower chest having a bottom panel, left and right sidewalls, a back wall and a top panel that are all molded together of a plastic material in a single unit having a box configuration surrounding an interior volume of the lower chest and having a front opening providing access to the interior volume; and, an upper chest having a bottom panel, left and right sidewalls, a back wall and a top panel that are all molded together of a plastic material in a single unit having a box configuration surrounding an interior volume of the upper chest and having a front opening providing access to the interior volume.

19. The tool chest assembly of claim 18, wherein:

the molded box configuration of the lower chest provides continuous linear connections between the back wall of the lower chest and the left and right sidewalls of the lower chest.

20. The tool chest assembly of claim 18, wherein:

the molded box configuration of the lower chest provides a continuous linear connection between the back wall of the lower chest and the bottom panel of the lower chest.

21. The tool chest assembly of claim 18, wherein:

the molded box configuration of the lower chest provides a continuous linear connection between the back wall of the lower chest and the top panel of the lower chest.

22. The tool chest assembly of claim 18, wherein:

the molded box configuration of the lower chest provides continuous linear connections between the bottom panel of the lower chest and the sidewalls of the lower chest.

23. The tool chest assembly of claim 18, wherein:

the molded box configuration of the lower chest provides continuous linear connections between the top panel of the lower chest and the sidewalls of the lower chest.

24. The tool chest assembly of claim 18, wherein:

the molded box configuration of the upper chest provides continuous linear connections between the back wall of the upper chest and the left and right sidewalls of the upper chest.

25. The tool chest assembly of claim 18, wherein:

the molded box configuration of the upper chest provides a continuous linear connection between the back wall of the upper chest and the bottom panel of the upper chest.

26. The tool chest assembly of claim 18, wherein:

the molded box configuration of the upper chest provides a continuous linear connection between the back wall of the upper chest and the top panel of the upper chest.

27. The tool chest assembly of claim 18, wherein:

the molded box configuration of the upper chest provides continuous linear connections between the bottom panel of the upper chest and the sidewalls of the upper chest.

28. The tool chest assembly of claim 18, wherein:

the molded box configuration of the upper chest provides continuous linear connections between the top panel of the upper chest and the sidewalls of the upper chest.

29. The tool chest assembly of claim 18, wherein:

the top panel of the lower chest is divided into forward and rearward sections, the upper chest is positioned on the rearward section and the forward section projects forwardly of the upper chest; and, a tray is formed in the interior volume of the lower chest beneath the forward section of the lower chest top panel, and the forward section of the lower chest top panel is connected to the lower chest for movement of the forward section relative to the lower chest between a closed position where the forward section covers over the tray and an open position where the forward section is displaced from over the tray exposing an access opening to the tray.

30. The tool chest assembly of claim 29, wherein:

at least one closure member is mounted on the lower chest for movement of the closure member relative to the lower chest between a closed position where the closure member is positioned in the front opening of the lower chest, and an open position where the closure member is displaced from the front opening of the lower chest; and, a means for locking the closure member in the closed position is provided in the tray.

31. The tool chest assembly of claim 30, wherein:

the means for locking the closure member in the closed position is an elongate bar having opposite bottom and top ends where the bottom end of the bar is inserted downwardly through a hole in the tray and the bar is positioned in front of the closure member with the bar top end positioned in the tray above the tray hole to lock the closure member in the closed position, and the bar is withdrawn upwardly through the tray hole from in front of the closure member to unlock the closure member.

32. The tool chest assembly of claim 18, wherein:

the top panel of the lower chest is divided into forward and rearward sections, the forward section having a work surface thereon and the rearward section being recessed below the forward section work surface, and the upper chest is positioned on the rearward section with the forward section projecting forwardly of the upper chest and with the forward section work surface and the upper chest bottom panel being substantially coplanar.

33. The tool chest assembly of claim 18, wherein:

the upper chest is provided with a lid that is connected to the upper chest for movement of the lid relative to the upper chest between a closed position where the lid covers over the top panel of the upper chest and an open position where the lid is displaced from over the top panel of the upper chest; and, a closure member is connected to the lid for movement of the closure member relative to the lid with the lid in its closed position wherein the movement of the closure member is between a closed position where the closure member is positioned in at least a portion of the upper chest front opening and an open position where the closure member is displaced from the upper chest front opening.

34. A tool chest assembly comprising:

a lower chest having a bottom panel, left and right sidewalls, a back wall and a top panel that are all connected together in a box configuration surrounding an interior volume of the lower chest and having a front opening providing access to the interior volume;

an upper chest having a bottom panel, left and right sidewalls, a back wall and a top panel that are all connected together in a box configuration surrounding an interior volume of the upper chest and having a front opening providing access to the interior volume of the upper chest;

the top panel of the lower chest is divided into forward and rearward sections, the forward section having a work surface thereon and the rearward section being recessed below the forward section work surface, and the upper chest is positioned on the rearward section with the forward section projecting forwardly of the upper chest and with the forward section work surface and the upper chest bottom panel being substantially coplanar.

35. The tool chest assembly of claim 34, wherein:

a tray is formed in the interior volume of the lower chest beneath the forward section of the lower chest top panel, and the forward section of the lower chest top panel is connected to the lower chest for movement of the forward section relative to the lower chest between a closed position where the forward section covers over the tray and an open position where the forward section is displaced from over the tray exposing an access opening to the tray.

36. The tool chest assembly of claim 35, wherein:

at least one closure member is mounted on the lower chest for movement of the closure member relative to the lower chest between a closed position where the closure member is positioned in the front opening of the lower chest, and an open position where the closure member is displaced from the front opening of the lower chest; and, a means for locking the closure member in the closed position is provided in the tray.

37. The tool chest assembly of claim 36, wherein:

the means for locking the closure member in the closed position is an elongate bar having opposite bottom and top ends where the bottom end of the bar is inserted downwardly through a hole in the tray and the bar is positioned in front of the closure member with the bar top end positioned in the tray above the tray hole to lock the closure member in the closed position, and the bar is withdrawn upwardly through the tray hole from in front of the closure member to unlock the closure member.

38. The tool chest assembly of claim 34, wherein:

the upper chest is provided with a lid that is connected to the upper chest for movement of the lid relative to the upper chest between a closed position where the lid covers over the top panel of the upper chest and an open position where the lid is displaced from over the top panel of the upper chest; and, a closure member is connected to the lid for movement of the closure member relative to the lid with the lid in its closed position wherein the movement of the closure member is between a closed position where the closure member is positioned in at least a portion of the upper chest front opening and an open position where the closure member is displaced from the upper chest front opening.

39. A tool chest assembly comprising:

a lower chest having a bottom panel, left and right sidewalls, a back wall and a top panel that are all connected together in a box configuration surrounding an interior volume of the lower chest and having a front opening providing access to the interior volume;

an upper chest having a bottom panel, left and right sidewalls, a back wall and a top panel that are all connected together in a box configuration surrounding an interior volume of the upper chest and having a front opening providing access to the interior volume of the upper chest;

the top panel of the lower chest is divided into forward and rearward sections, the upper chest is positioned on the rearward section and the forward section projects forwardly of the upper chest front opening;

at least one closure member is mounted on the lower chest for movement of the closure member relative to the lower chest between a closed position where the closure member is positioned in the front opening of the lower chest and prevents access to at least a portion of the lower chest interior volume, and an open position where the closure member is displaced from the front opening of the lower chest and allows access to the portion of the lower chest interior volume;

an elongate bar for locking the closure member in the closed position, the bar having opposite bottom and top ends where the bottom end of the bar is inserted downwardly through a hole in the forward section of the lower chest top panel and the bar is positioned in front of the closure member with the bar top end positioned above the hole in the forward section to lock the closure member in the closed position, and the bar is withdrawn upwardly through the hole in the forward section from in front of the closure member to unlock the closure member, and the bottom end of the bar is inserted downwardly through a second hole in the forward section and is positioned inside the interior volume of the lower chest to one side of the lower chest front opening with the bar top end positioned above the second hole in the forward section to store the lock bar.

40. The tool chest assembly of claim 39, wherein:

the forward section of the lower chest top panel is configured as a tray having a storage compartment that is separated from the interior volume of the lower chest by the tray and is accessible only through an access opening above the tray; and a door is connected to the forward section for movement of the door relative to the lower chest between a closed position where the door covers over the tray and an open position where the door is displaced from over the tray exposing the access opening to the tray.

41. The tool chest apparatus of claim 40, wherein:

the door is connected to the lower chest for pivoting movement of the door relative to the lower chest between the closed and open positions.

42. The tool chest apparatus of claim 39, wherein:

the closure member is a drawer mounted in the interior volume of the lower chest for sliding movement relative to the lower chest backward and forward through the front opening of the lower chest.

43. The tool chest apparatus of claim 39, wherein:

the closure member is a door mounted on the lower chest for pivoting movement relative to the lower chest between a closed position where the door is positioned in at least a portion of the lower chest front opening and an open position where the door is displaced from the portion of the lower chest front opening.

44. The tool chest assembly of claim 39, wherein:

the upper chest is provided with a lid that is connected to the upper chest for movement of the lid relative to the upper chest between a closed position where the lid covers over the top panel of the upper chest and a open position where the lid is displaced from over the top panel of the upper chest; and, a closure member is connected to the lid for movement of the closure member relative to the lid with the lid in its closed position wherein the movement of the closure member is between a closed position where the closure member is positioned in at least a portion of the upper chest front opening and an open position where the closure member is displaced from the upper chest front opening.

45. The tool chest assembly of claim 44, wherein:

the lid has opposite rearward and forward edges and a hinge assembly connects the lid rearward edge to the upper chest, and the closure member is a door having a top edge and a hinge assembly connects the door top edge to the lid forward edge.

46. The tool chest assembly of claim 39, wherein:

the top and bottom panels, left and right sidewalls and the back wall of the lower chest are all molded together as a single unit of a plastic material and the top and bottom panels, left and right sidewalls and the back wall of the upper chest are all molded together as a single unit of a plastic material.

47. A tool chest assembly adapted to be supported on a floor of a work area, the tool chest assembly comprising:

a bottom panel, left sidewall, right sidewall, back wall and top panel all rigidly interconnected together in a box configuration surrounding an interior volume of the chest assembly and having a front opening providing access to the interior volume, the top panel having a generally flat top support surface and at least one storage bin adjacent the top surface, the storage bin depending below the top surface and having an interior accessible through an opening adjacent the top surface and the left and right sidewalls and the back wall elevating the top surface of the top panel a sufficient height for use of the top surface as a worktable.

48. The tool chest assembly of claim 47, wherein:

the storage bin has a configuration that separates the interior of the storage bin from the interior volume of the tool chest assembly.

49. The tool chest assembly of claim 47, wherein:

has a front opening providing access to the interior volume of the storage bin is positioned in a forward portion of the top panel and generally above the front opening.

50. The tool chest assembly of claim 49, wherein:

the storage bin is comprised of a plurality of separated compartments.

51. The tool chest assembly of claim 47, wherein:

the tool chest assembly is constructed of plastic molded component parts.

52. The tool chest assembly of claim 51, wherein:

at least some of the plastic molded component parts are connected together by fasteners, and the fasteners have threaded lengths that are entirely embedded in the plastic of component parts connected together by the fasteners thereby providing a strong rigid connection between the component parts.

53. The tool chest assembly of claim 47, wherein:

the left and right sidewalls, the back wall and the top panel are all constructed of molded plastic, and at least the top panel support surface is rigidly connected statically to the left and right sidewalls and the back wall by a plurality of fasteners having threaded lengths.

54. The tool chest assembly of claim 53, wherein:

the threaded lengths of the plurality of fasteners are completely embedded in molded plastic, thereby providing a rigid connection between the support panel top surface and the left and right sidewalls and the back wall.

55. The tool chest assembly of claim 47, wherein:

the left and right sidewalls and the back wall all are integrally a single unit of molded plastic construction.

56. The tool chest assembly of claim 47, wherein:

the bottom panel, left and right sidewalls, the back wall and the top panel all are integrally a single unit of molded plastic construction.

57. The tool chest assembly of claim 47, wherein:

the left and right sidewalls are of molded plastic construction with a depression centered in exterior surfaces of the sidewalls, the centered depressions providing strength and rigidity to the sidewalls.

58. The tool chest assembly of claim 47, wherein:

the bottom panel is of plastic molded construction with a top support surface and a reinforcing perimeter band extending downward from a perimeter of the bottom panel, and a plurality of crisscrossing reinforcing webs are molded of plastic on an underside of the bottom panel providing structural strength and rigidity to the bottom panel.

59. The tool chest assembly of claim 58, wherein:

a plurality of wheel assemblies are mounted to the underside of the bottom panel at crisscrossing intersections of the reinforcing webs.

60. The tool chest assembly of claim 47, wherein:

the top support surface of the top panel is adapted to support a separate tool box thereon with the storage bin positioned in front of and being unobstructed by the tool box supported on the top support surface.

61. A tool chest assembly adapted to be supported on a floor of a work area, the tool chest assembly comprising:

bottom panel, left sidewall, right sidewall, back wall and top panel component parts of the tool chest assembly, all constructed of molded plastic and rigidly connected together in a box configuration surrounding an interior volume of the tool chest assembly accessible through a front opening of the tool chest assembly, the component parts of the tool chest assembly also including a top support surface on the top panel also constructed of molded plastic, and at least two component parts of the tool chest assembly being connected together by fasteners having threaded lengths.

62. The tool chest assembly of claim 61, wherein:

the threaded lengths of at least some of the fasteners are entirely embedded in the molded plastic of the two component parts connected together by the fasteners.

63. The tool chest assembly of claim 61, wherein:

the left and right sidewalls and the back wall all are integrally a single unit of molded plastic construction.

64. The tool chest assembly of claim 61, wherein:

the bottom panel, left and right sidewalls, the back wall and the top panel all are integrally a single unit of molded plastic construction.

65. The tool chest assembly of claim 61, wherein:

the top panel has a storage bin molded therein, the storage bin being positioned adjacent the top support surface of the top panel and being of molded plastic construction with an interior depending below the top support surface, the interior of the storage bin being accessible through a top opening of the bin.

66. The tool chest assembly of claim 61, wherein:

a plurality of crisscrossing reinforcing webs are molded on an underside of the bottom panel providing strength and rigidity to the panel, and wheel assemblies are mounted to the underside of the bottom panel at intersections of the reinforcing webs.

67. The tool chest assembly of claim 65, wherein:

the top panel is adapted to support an upper tool chest assembly thereon without obstructing access to the storage bin opening.

68. The tool chest assembly of claim 62, wherein:

the left and right sidewalls are each molded with an exterior surface having a depression at its center and with an interior surface having a plurality of reinforcing webs molded thereon, together the center depression and the reinforcing webs add strength and rigidity to each sidewall.

69. A tool chest assembly adapted to be supported on a floor of a work area for easy access by a user while standing, the tool chest assembly comprising:

a top panel;

a plastic molded frame structure for supporting the top panel above the floor a sufficient height for easy access by the user and to enable use of the top panel as a worktable, the top panel having a top surface extending over a major portion of the top panel, and a parts bin formed near the front of the top panel at least a portion of which is located forwardly of the top surface, said parts bin being accessible at the top of the bin;

said top panel, including said parts bin, being of plastic molded construction.

70. The tool chest assembly of claim 69, wherein:

the top panel, including the parts bin, is of unitary, plastic molded construction.

71. The tool chest assembly of claim 70, wherein:

the parts bin has dividers for dividing the bin into multiple compartments.

72. The tool chest assembly of claim 71, further comprising:

wheels for supporting the tool chest assembly on the floor.

73. A tool chest assembly adapted to be supported on a floor of a word area for easy access by a user while standing, the tool chest assembly comprising:

bottom panel, left sidewall, right sidewall, back wall and top panel, all constructed of molded plastic and rigidly connected together to define an interior volume of a tool chest assembly accessible through a front opening of the tool chest assembly, the component parts of the tool chest assembly also including a top surface on the top panel also constructed of molded plastic, said top surface extending over a major portion of the top panel and a parts bin formed near the front of the top panel at least a portion of which is located forwardly of the top surface, said parts bin being accessible at the top of the bin.

74. The tool chest assembly of claim 73, wherein:

said top panel, including said parts bin, is of one piece, molded plastic construction.

75. The tool chest assembly of claim 74, wherein:

the parts bin has dividers for dividing the bin into multiple compartments.

76. The tool chest assembly of claim 75, further comprising:

wheels for supporting the tool chest assembly on the floor.

77. The tool chest assembly of claim 76, further comprising:

drawers mounted within said interior volume of the tool chest assembly which open at the front opening.

* * * * *